US006695230B1

(12) United States Patent
Boecking

(10) Patent No.: US 6,695,230 B1
(45) Date of Patent: Feb. 24, 2004

(54) BLIND BORE INJECTION NOZZLE FOR INTERNAL COMBUSTION ENGINES, WITH A ROUNDED TRANSITION BETWEEN THE BLIND BORE AND THE NOZZLE NEEDLE SEAT

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 276 days.

(21) Appl. No.: 09/786,714

(22) Filed: Jun. 18, 2001

(30) Foreign Application Priority Data

Jul. 8, 1999 (DE) ..... 199 31 761

(51) Int. Cl.[7] ..... F02M 39/00

(52) U.S. Cl. ..... 239/533.3; 239/533.8; 239/533.12; 239/584

(58) Field of Search ..... 239/88, 96, 533.3, 239/533.8, 533.9, 584, 533.2, 533.12

(56) References Cited

U.S. PATENT DOCUMENTS

| | | | | |
|---|---|---|---|---|
| 2,927,737 A | * | 3/1960 | Zeuch et al. | 239/533.3 |
| 3,836,080 A | | 9/1974 | Butterfield et al. | |
| 4,035,204 A | * | 7/1977 | Hack et al. | 123/188.8 |
| 4,069,978 A | * | 1/1978 | El Moussa | 239/533.2 |
| 4,417,694 A | * | 11/1983 | Claxton et al. | 239/533.12 |
| 4,890,794 A | * | 1/1990 | Imafuku et al. | 239/533.12 |
| 5,026,462 A | * | 6/1991 | Butterfield et al. | 205/670 |
| 5,033,679 A | * | 7/1991 | Golev et al. | 239/533.3 |
| 5,787,708 A | * | 8/1998 | Lane et al. | 239/533.9 |

FOREIGN PATENT DOCUMENTS

| | | |
|---|---|---|
| DE | 37 40 283 A1 | 8/1989 |
| EP | 0 370 659 A 1 | 11/1989 |
| EP | 0 730 089 A 1 | 9/1995 |
| GB | 2 186 632 A | 8/1987 |

* cited by examiner

*Primary Examiner*—Steven J. Ganey
(74) *Attorney, Agent, or Firm*—Ronald E. Greigg

(57) ABSTRACT

An injection nozzle with a blind bore is disclosed in which the transition between the blind bore and the nozzle needle seat is rounded. This decreases the tolerance in the flow resistance of the injection nozzle upon a partial stroke of the nozzle needle, and thus makes a more-precise control of the injected fuel quantity possible.

20 Claims, 1 Drawing Sheet

BLIND BORE INJECTION NOZZLE FOR INTERNAL COMBUSTION ENGINES, WITH A ROUNDED TRANSITION BETWEEN THE BLIND BORE AND THE NOZZLE NEEDLE SEAT

CROSS-REFERENCE TO RELATED APPLICATIONS

This application is a 35 USC 371 application of PCT/DE 00/02125 filed on Jun. 29, 2000.

BACKGROUND OF THE INVENTION

1. Field of the Invention

The invention is directed to an injection nozzle for internal combustion engines, and particularly to such an injection nozzle having a blind bore that has at least one injection port, and having a nozzle needle seat adjoining the blind bore.

2. Description of the Prior Art

Blind bore injection nozzles of the type with which the invention is concerned, particularly in the partial stroke range of the nozzle needle, have great variation of the flow resistance and thus also of the injected fuel quantity. As a consequence, the emissions and fuel consumption of many internal combustion engines equipped with these blind bore injection nozzles is other than optimal.

SUMMARY OF THE INVENTION

The object of the invention is to furnish a blind bore injection nozzle in which the variation in the injection quantity in the partial-load range of the nozzle needle from one example to another of a blind bore injection nozzle of the same design is reduced, and thus the fuel consumption and emissions of the engines equipped with the blind bore injection nozzle of the invention are improved.

This object is attained by an injection nozzle for internal combustion engines, having a blind bore that has at least one injection port, and having a nozzle needle seat adjoining the blind bore, in which the transition between the nozzle needle seat and the blind bore is rounded.

Because the transition between the nozzle needle seat and the blind bore is rounded according to the invention and thus has a defined geometry, the throttling action of the transition between the nozzle needle seat and the blind bore, which action is definitive in the partial-load range of the nozzle needle, is also defined, and thus between various examples of an injection nozzle of the same design now varies to only a very slight extent. Thus by measurement of the operating performance of a blind bore injection nozzle according to the invention, the operating performance of all the other blind bore injection nozzles of the same design can be predicted with substantially greater precision, and the control of the injection event can be optimized accordingly.

In one feature of the invention, the transition between the nozzle needle seat and the blind bore is rounded with a radius between 0.01 mm and 0.1 mm, preferably between 0.04 mm and 0.06 mm, so that on the one hand the rounding already markedly reduces the variation in the partial-load performance of the injection nozzles, and on the other the rounding can be achieved at little cost.

In a further version of the invention, the blind bore is conical, so that the partial-load performance of conical blind bore injection nozzles is improved.

In a further feature of the invention, it is provided that the blind bore is embodied cylindrically, so that the partial-load performance of cylindrical blind bore injection nozzles is improved as well.

A variant of an injection nozzle of the invention provides that the nozzle needle seat is frustoconical, which results in good sealing action and good centering of the nozzle needle in the nozzle needle seat.

In another version of the invention, the cone angle of the nozzle needle seat is 60°, so that a good sealing action between the nozzle needle and the nozzle needle seat is attained.

In a further feature of the invention, the cone angle of the nozzle needle is up to 1°, and preferably from 15 to 30 angular minutes greater than the cone angle of the nozzle needle seat, so that the sealing area is reduced and is shifted into the region of the greatest diameter of the nozzle needle.

Another version provides that the blind bore is a mini blind bore or a micro blind bore, so that the advantages according to the invention can be utilized in these injection nozzles as well.

In another version, the transition between the injection port and the blind bore is rounded, so that the throttling action of the injection port is reduced and varies within a narrower tolerance range.

The object stated at the outset is also attained by an injection nozzle for internal combustion engines, having a blind bore that has at least one injection port, characterized in that the transition between the injection port and the blind bore is rounded. This provision lessens the variation in the operating performance of the injection nozzles.

BRIEF DESCRIPTION OF THE DRAWINGS

Further advantages and advantageous features of the invention can be learned from the ensuing description, taken with the drawings, in which.

DESCRIPTION OF THE PREFERRED EMBODIMENTS

Figure 1:
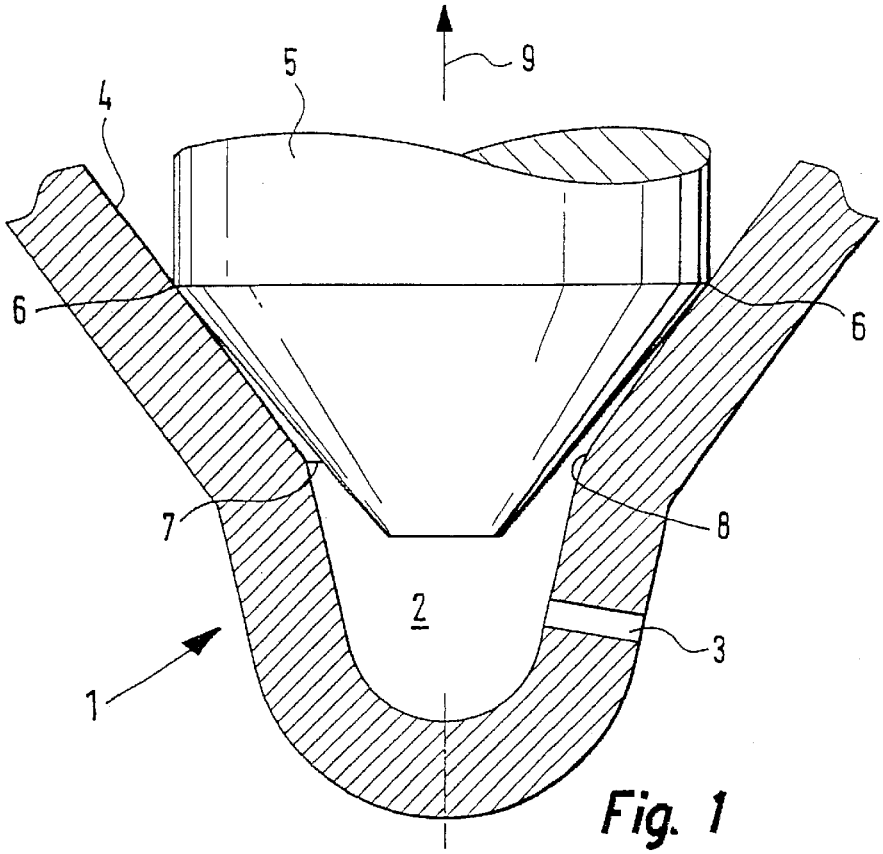
FIG. 1 is a fragmentary elevation view, in section of a blind bore injection nozzle.

In FIG. 1, an injection nozzle 1 with a conical blind bore 2 is shown. The blind bore 2 can also be cylindrical, or it can be a mini blind bore or micro blind bore 2. In the case of the micro blind bore, the volume of the blind bore 2 is reduced compared to the design shown in FIG. 1. Thus when the internal combustion engine has been shut off, less fuel evaporates into the combustion chamber.

Via an injection port 3, the fuel, not shown, from the blind bore 2 reaches the combustion chamber, also not shown. The conical blind bore 2 is adjoined by a frustoconical nozzle needle seat 4. The nozzle needle seat 4 can, for example, have a cone angle of 60°. The blind bore 2 need not be conical; it can be cylindrical instead.

A nozzle needle 5 rests on the nozzle needle seat 4. In FIG. 1, it can be seen clearly that the cone angle of the nozzle needle 5 is greater than the cone angle of the nozzle needle seat 4. As a result, the contact zone 6 between the nozzle needle 5 and the nozzle needle seat 4 is located in the region of the greatest diameter of the nozzle needle 5, and the pressure per unit of surface area between the nozzle needle 5 and the nozzle needle seat 4 is increased. The difference in the cone angles of the nozzle needle 5 and nozzle needle seat 4 is shown on an exaggerated scale in FIG. 1. As a rule, this difference is less than 1° and ranges within the range of a few angular minutes.

On the left-hand side of FIG. 1, a transition between the blind bore 2 and the nozzle needle seat 4 in the prior art is shown in the form of an edge 7. This edge 7 is created in the grinding of the nozzle needle seat 4. Depending on the type of machining, the edge 7 can be a sharp burr or a smooth edge. The flow resistance of the edge 7 is influenced substantially by the nature of the edge itself.

On the right-hand side of FIG. 1, a transition 8 between the blind bore 2 and the nozzle needle seat 4 is shown that is rounded according to the invention. The rounding of the transition 8 can for instance be circular in cross section, with the radius being in the range from 0.01 mm to 0.1 mm, preferably 0.04 mm to 0.06 mm. The rounding according to the invention in each case means that the geometry of the transition 8 between the nozzle needle seat 4 and the blind bore 2, in injection nozzles 1 of the same design, now varies only within a very narrow tolerance range; that is, the geometry of the transition 8 is defined, and thus the flow resistance of the transition 8 is also uniquely defined, when the nozzle needle 5 is lifted from the nozzle needle seat 4 in the direction of a nozzle needle stroke 9. Accordingly, the variation in the flow resistance of different examples of injection nozzles according to the invention in the region of the transition 8 between the nozzle needle seat 4 and the blind bore 2 decreases sharply.

The consequences of the variation in the flow resistance of injection nozzles 1 in the region of the transition 7 or 8 will be described in conjunction with the graph shown in FIG. 2.

Figure 2:
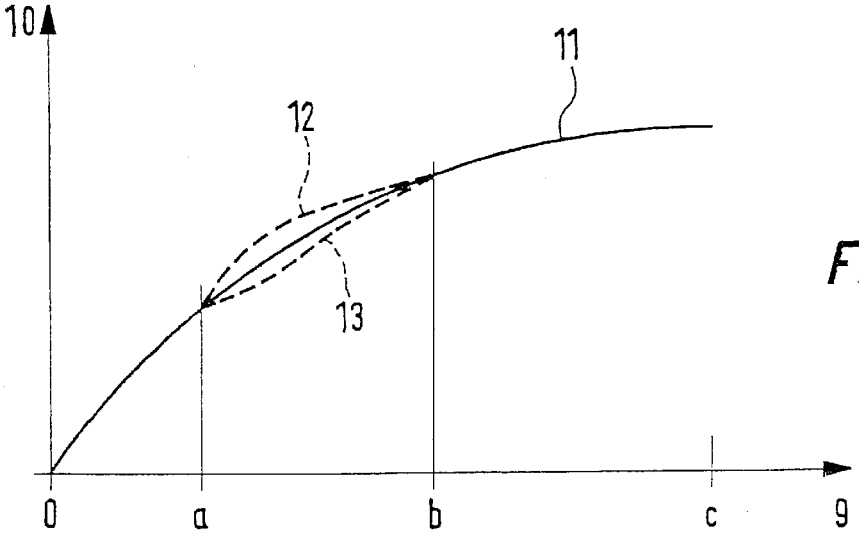
FIG. 2 is a characteristic curve of the hydraulic diameter of the injection nozzle, plotted over the stroke of the nozzle needle.

In FIG. 2, the hydraulic diameter 10 of a blind bore injection nozzle 1 is plotted qualitatively over the nozzle needle stroke 9. The hydraulic diameter 10 is a variable by means of which arbitrary cross sections through which there is a flow are made comparable with regard to their flow resistance. The flow resistance of a tube of circular cross section serves as the reference variable. A cross section with a large hydraulic diameter has a low flow resistance, and vice versa.

In FIG. 2, the nozzle needle stroke 9 has been subdivided into two ranges. A first range extends from zero to "a", and the second range, hereinafter called the partial-stroke range, extends from "a" to "b". The full nozzle needle stroke is reached at "c".

When a closed injection nozzle 1, in which the nozzle needle 5 is resting on the nozzle needle seat 4, is opened, the result, at a very short nozzle needle stroke 9 in the region of the contact zone 6, is a very narrow gap, through which the fuel which is under pressure can flow into the blind bore 2. This very narrow gap definitively determines the flow resistance of the injection nozzle 1 and thus also determines the hydraulic diameter 10. Since the flow resistance of this very narrow gap is high, the hydraulic diameter 10 of the injection nozzle 1 is very small, for a very short nozzle needle stroke 9.

In the partial-stroke range between "a" and "b", the flow resistance of the injection nozzle 1 is definitively determined by the edge 7 or the transition 8 between the nozzle needle seat 4 and the blind bore 2. Thus the edge 7 or the transition 8 in the partial-stroke range is also of major significance for the hydraulic diameter of the injection nozzle 1. This means that changes in the geometry of the edge 7 or the transition 8 between the nozzle needle seat 4 and the blind bore 2 result in changes in the hydraulic diameter 10. In the range of the full nozzle needle stroke "c", the injection port 3 of the injection nozzle 1 is definitive for the hydraulic diameter of the injection nozzle 1.

In accordance with what has been said above, variations in the geometry of the edge 7 or the transition 8 lead to a change in the characteristic curve 11 of the injection nozzle 1, above all in the partial-stroke range between "a" and "b".

The possibility of rounding the transition between the blind bore 2 and the injection port 3 as well has not been shown in FIG. 1. Doing so decreases the flow resistance of the injection nozzle, and prevents a burr from remaining for instance when the injection port 3 is drilled, which as a rule is done from the outside inward. Such a burr can cause the flow resistance of an injection nozzle 1 to rise, especially at the full nozzle needle stroke. The resultant disadvantages are equivalent to the disadvantages, already mentioned and described in further detail below, of injection nozzles 1 in which the flow resistance of the edge 7 or transition 8 varies sharply.

In FIG. 2, the effects of different geometries of the transition 7 or 8 on the hydraulic diameter in the partial-stroke range have been represented in graphical form by the characteristic curves 11, 12 and 13. The characteristic curve 12 drawn in dashed lines represents a geometry of an edge 7 or transition 8 which has a larger hydraulic diameter in comparison to the characteristic curve 11 and accordingly has lesser throttling losses. The characteristic curve 13 drawn in dashed lines illustrates the effects of a geometry of a transition 7 or 8 which relative to the characteristic 11 in FIG. 2 has a greater throttling action.

In mass-produced internal combustion engines, the performance graph of the engine and of the associated injection system is ascertained by measurements made using one or more selected test examples. The performance graphs ascertained in this way are made the basis for all injection systems of the same design.

It will be assumed below that the characteristic curve 11 is a measured characteristic curve, and that this characteristic curve 11 is stored in memory in the control unit of the injection system. It is also assumed that two injection nozzles taken from mass production have the characteristic curves 12 and 13. If the injection nozzles 1 having the characteristic curves 12 and 13 now cooperate with a control unit in which the characteristic curve 11 is stored in memory, then the actual injection quantity in the partial-stroke range does not match the optimal injection quantity measured in the test examples and plotted on the characteristic curve 11, resulting in impaired engine performance and/or emissions.

Conversely, it can be stated that as a result of the rounding of the transition 8 between the nozzle needle seat 4 and the blind bore 2, the variation in the characteristic curves 11, 12 and 13 is reduced. This markedly improves the agreement between the characteristic curve 11 stored in memory in the control unit and the characteristic curves 11 and 13 of two injection nozzles taken from mass production. The agreement can be improved by a factor of 2 to 3, for example. Consequently, the actually injected fuel quantity matches the injection quantity specified by the control unit precisely, and the fuel consumption and emissions of the engine are optimal.

The foregoing relates to preferred exemplary embodiments of the invention, it being understood that other variants and embodiments thereof are possible within the spirit and scope of the invention, the latter being defined by the appended claims.

I claim:

1. An injection nozzle (1) for internal combustion engines, comprising a blind bore (2) having at least one injection port (3), a nozzle needle seat (4) adjoining the blind bore (2), and a transition (8) between the nozzle needle seat (4) and the blind bore (2), said transition (8) being rounded, wherein the transition (8) between the nozzle needle seat (4) and the blind bore (2) is rounded with a radius between 0.01 mm and 0.1 mm.

2. The injection nozzle (1) of claim 1, wherein the transition (8) between the nozzle needle seat (4) and the blind bore (2) is rounded with a radius between 0.04 mm and 0.06 mm.

3. The injection nozzle (1) of claim 2, wherein the blind bore (2) is conical.

4. The injection nozzle (1) of claim 2, wherein the blind bore (2) is cylindrical.

5. The injection nozzle (1) of claim 2, wherein the nozzle needle seat (4) is frustoconical.

6. The injection nozzle (1) of claim 2, wherein the cone angle of the nozzle needle seat (4) is 60°.

7. The injection nozzle (1) of claim 2, wherein the blind bore (2) is a mini blind bore or a micro blind bore.

8. The injection nozzle (1) of claim 1, wherein the blind bore (2) is conical.

9. The injection nozzle (1) of claim 8, wherein the nozzle needle seat (4) is frustoconical.

10. The injection nozzle (1) of claim 8, wherein the cone angle of the nozzle needle seat (4) is 60°.

11. The injection nozzle (1) of claim 1, wherein the blind bore (2) is cylindrical.

12. The injection nozzle (1) of claim 11, wherein the nozzle needle seat (4) is frustoconical.

13. The injection nozzle (1) of claim 11, wherein the cone angle of the nozzle needle seat (4) is 60°.

14. The injection nozzle (1) of claim wherein the nozzle needle seat (4) is frustoconical.

15. The injection nozzle (1) of claim 14, wherein the cone angle of the nozzle needle seat (4) is 60°.

16. The injection nozzle (1) of claim 14, including a nozzle needle (5) with a cone angle, wherein the cone angle of the nozzle needle (5) is up to 1°, angular minutes greater than the cone angle of the nozzle needle seat (4).

17. The injection nozzle (1) of claim 16, wherein the cone angle of the nozzle needle (5) is from 15 to 30 angular minutes greater than the cone angle of the nozzle needle seat (4).

18. The injection nozzle (1) of claim 1, wherein the blind bore (2) is a mini blind bore or a micro blind bore.

19. The injection nozzle (1) of claim 1, wherein the transition between the injection port (3) and the blind bore (2) is rounded.

20. The injection nozzle (1) of claim 1, wherein the blind bore (2) that has at least one injection port (3), comprising a transition between the injection port (3) and the blind bore (2) that is rounded.

* * * * *

UNITED STATES PATENT AND TRADEMARK OFFICE

CERTIFICATE OF CORRECTION

PATENT NO. : 6,695,230 B1
DATED : February 24, 2004
INVENTOR(S) : Friedrich Boecking It is certified that error appears in the above-identified patent and that said Letters Patent is hereby corrected as shown below:

Title page,
Insert item:
-- [86] PCT No.: PCT/DE 00/02125
§ 371 (c)(1),
(2), (4) Date: June 29, 2000 --

Signed and Sealed this

Thirteenth Day of April, 2004

JON W. DUDAS
*Acting Director of the United States Patent and Trademark Office*